US005320287A

United States Patent [19]

Li

[11] Patent Number: 5,320,287

[45] Date of Patent: Jun. 14, 1994

[54] PAPER SHREDDING KNIFE STRUCTURE FOR PAPER SHREDDER

[76] Inventor: Yi-Yang Li, No. 7, Lane 15, Chang Chun St., Hsinchu City, Taiwan

[21] Appl. No.: 138,760

[22] Filed: Oct. 18, 1993

[51] Int. Cl.[5] ..... B02C 18/06

[52] U.S. Cl. ..... 241/102; 241/235; 241/293

[58] Field of Search ..... 241/293, 295, 235, 102

[56] References Cited

U.S. PATENT DOCUMENTS

| | | | |
|---|---|---|---|
| 1,681,920 | 8/1928 | Baccellieri | 241/293 |
| 2,306,427 | 12/1942 | Christman et al. | 241/235 |
| 2,962,230 | 11/1960 | Dilley et al. | 241/102 |
| 3,070,318 | 12/1962 | Blanchard | 241/102 |
| 3,089,409 | 5/1963 | Tretheway et al. | 241/295 |
| 3,406,624 | 10/1968 | Kutchera et al. | 241/235 |

*Primary Examiner*—Mark Rosenbaum
*Assistant Examiner*—John M. Husar
*Attorney, Agent, or Firm*—Brumbaugh, Graves, Donohue & Raymond

[57] ABSTRACT

A paper shredding knife structure includes a number of zigzag disk-like knife blades, each having a sharp outer edge, mounted on a knife support shaft, one by one closely adjacent each other so as to define a number of rhombic spaces between any two adjacent blades. A roller, preferably comprising a resilient material outer coating, is mounted in such a way to allow the knife blades to be in tight contact engagement with the roller so that when the knife support shaft and the roller are rotated with a sheet of paper feed through therebetween, the zigzag blades cut the paper sheet into small rhombic pieces.

3 Claims, 3 Drawing Sheets

PAPER SHREDDING KNIFE STRUCTURE FOR PAPER SHREDDER

FIELD OF THE INVENTION

The present invention relates generally to a paper shredder and in particular to a paper shredding knife structure for use in the paper shredder.

BACKGROUND OF THE INVENTION

Conventional paper shredder comprises a pair of spaced but parallel rotating shafts on each of which a number of disk-shaped knives are mounted in an equally spaced manner. The knives of one shaft are snugly received within spaces between the knives of the other shaft so that by having a sheet of paper to be shredded pass through therebetween, the sheet is cut into pieces by the cutting action provided by the knives. The conventional shredding knife structure comprises uniform flat disks which forms linear cutting traces on the paper sheet so that the shredded sheet is cut into a number of parallel long slender strips.

Some of the disadvantages of such a conventional paper shredding knife structure are:

(1) Since the result of paper shredding is a number of parallel strips, it is quite possible for the malignant to re-assemble the strips back to the original sheet and thus revealing the contents thereof; and (2) The long paper strips that are formed during paper shredding are very easy to curl and thus forming a very loose mass which occupies a great space.

It is therefore desirable to provide a paper shredding knife structure which overcomes the above-mentioned problems.

SUMMARY OF THE INVENTION

The principal objective of the present invention is to provide a paper shredding knife structure which cuts the paper sheet into a small pieces rather than strips so as to provide a better confidentiality of paper shredding and a saving in space that is occupied by the shredded paper pieces.

It is another objective of the present invention to provide a paper shredder which incorporate such a paper shredding knife structure to shred paper sheet into small non-curling pieces.

To achieve the above objectives, there is provided a paper shredding knife structure comprising a number of zigzag disk-like knife blades, each having a sharp outer edge, mounted on a knife support shaft, one by one closely adjacent each other so as to define a number of rhombic spaces between any two adjacent blades. A roller, preferably comprising a resilient material outer coating, is mounted in such a way to allow the knife blades to be in tight contact engagement with the roller so that when the knife support shaft and the roller are rotated with a sheet of paper feed through therebetween, the zigzag blades cut the paper sheet into small rhombic pieces.

BRIEF DESCRIPTION OF THE DRAWING

The present invention will be better understood from the following description of a preferred embodiment of the present invention, with reference to the attached drawings, wherein.

DETAILED DESCRIPTION OF THE PREFERRED EMBODIMENT

Figure 1:
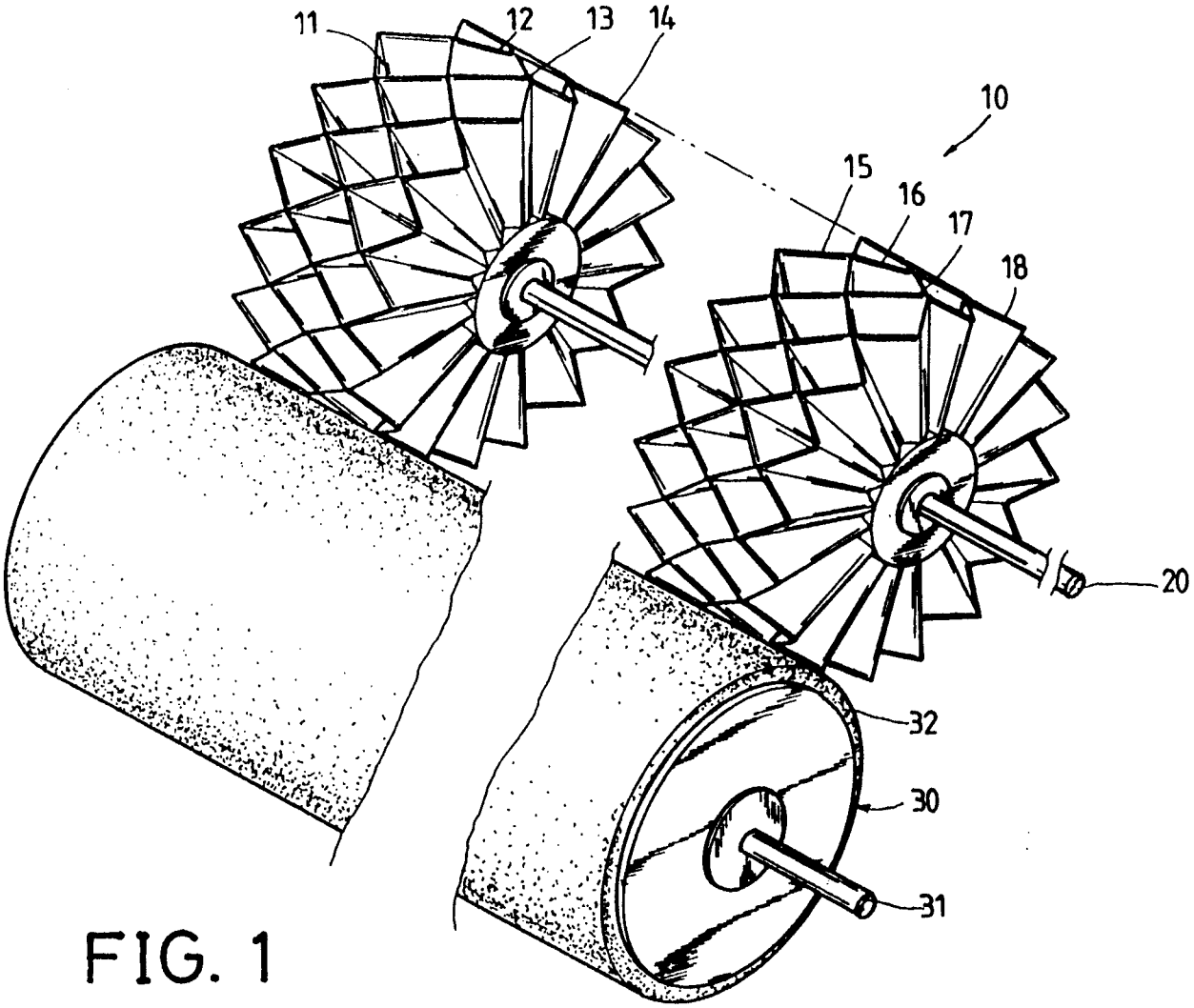
FIG. 1 is a perspective view showing a paper shredding knife structure constructed in accordance with the present invention with a resilient roller in tight contact engagement therewith.
Figure 3:
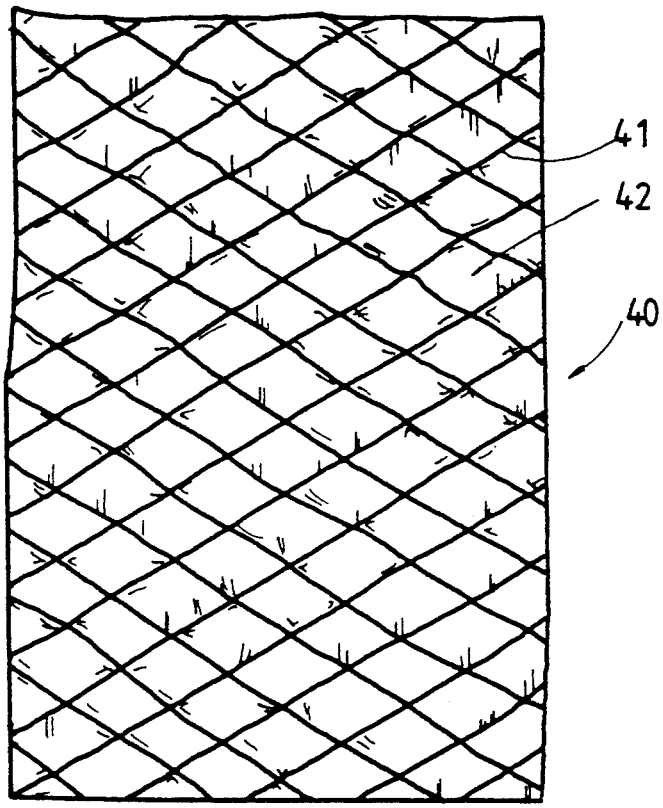
FIG. 3 is a top view showing the cutting traces of a sheet of paper processed by the paper shredding knife of the present invention.

With reference to the drawings and in particular FIG. 1, wherein a paper shredding knife constructed in accordance with the present invention, generally designated with the reference numeral 10, is shown, the paper shredding knife 10 is to be used in a paper shredder (not shown) by cooperating with a resilient roller 30 to cut a sheet of paper 40 into small pieces 42 (see FIG. 3).

Figure 2:
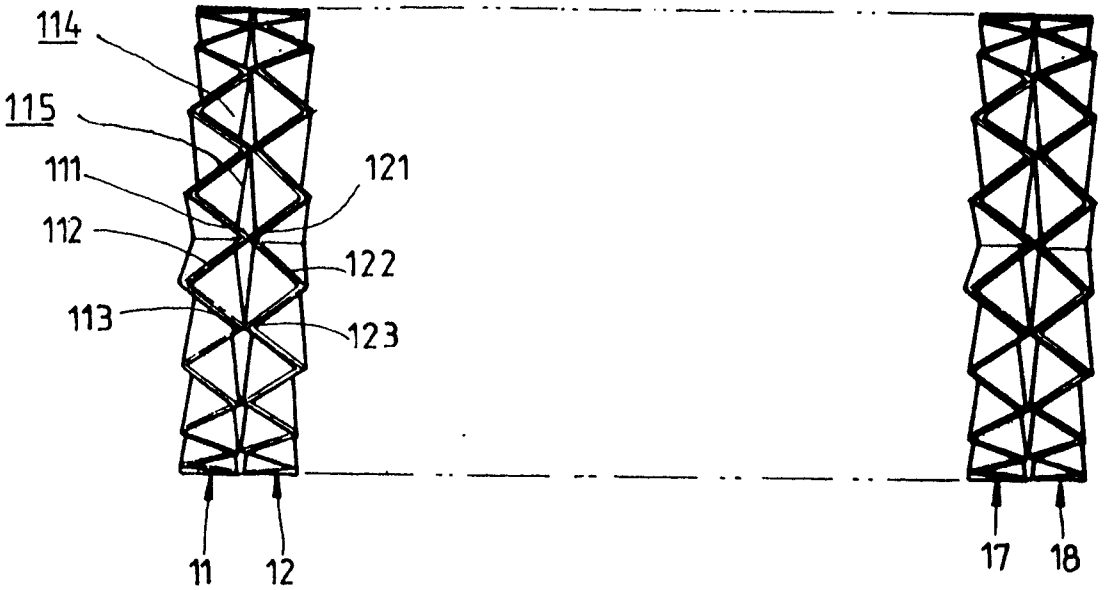
FIG. 2 is a side elevational view showing the paper shredding knife structure of the present invention.

In the embodiment illustrated, the paper shredding knife 10 comprises a number of zigzag disk-like blades 11–18 mounted on a knife support shaft 20 in a close adjacent manner, each of which blades has a sharp outer edge, such as 112 or 122 shown in FIG. 2. The shaft 20 is driven by driving means, such as an electrical motor (not shown), to rotate. The zigzag disk-like blades 11–18 are so mounted on the shaft 20 that corners 111, 113 or 121, 123 of two adjacent zigzag blades, such as blades 11 and 12, are in contact with each other, see FIG. 2, so as to define a plurality of substantially rhombic or square spaces, such as 114 and 115 shown in FIG. 2.

The roller 30 has an axle 31 disposed in substantially parallel with the knife support shaft 20 so as to allow the outer sharp edges, such as 112 and 122, of the blades 11–18 in tight contact engagement with the resilient roller 30. Preferably, the resilient roller 30 comprises a surface coating 30 made of a resilient material, preferably rubber, mounted thereon to provide the tight contact engagement with the outer sharp edges of the knife blades 11–18 so that when the sheet of paper 40 is fed through between the roller 30 and the blades 11–18, a net-like trace 41 of the blades is formed thereon with the sheet 40 being cut into a number of rhombic pieces 42, as shown in FIG. 3. In general, such small rhombic paper pieces 42 will not curl by themselves.

In operation, the knife support shaft 20 is driven to rotate and with the tight contact engagement thereof with the roller 30, the roller 30 is also driven to follow the shaft 20 to rotate substantially in unison with the shaft 20. The sheet of paper 40, once fed into between the blades 11–18 and the roller 30, is automatically driven by the engagement between the blades 11–18 and the roller 30 to pass through between the blades 11–18 and the roller 30 and thus cut by the sharp edges of the blades 11–18 which are in tight contact engagement with the roller 30 into small rhombic pieces 42.

Since the sheet of paper 40 is cut into small pieces rather than long slender strips, greater confidentiality of the contents of the shredded paper can be obtained. Further, such small pieces will not curl as that happens to the long slender strips obtained in the convention paper shredder so that a saving in space that is occupied by the cut paper can be achieved.

It is apparent that although the invention has been described in connection with the preferred embodiment, it is contemplated that those skilled in the art may make changes to the preferred embodiment without departing from the spirit and scope of the invention as defined in the appended claims.

What is claimed is:

1. A paper shredder comprising: a paper shredding knife having a number of zigzag disk-like blades, each having a sharp outer edge defining a number of corners by the zigzag thereof, mounted on a knife support shaft in a closely adjacent manner so as to have the corners of two adjacent blades of the number of zigzag blades in contact with each other to define a number of substantially rhombic spaces between the two adjacent blades, and a roller having a rotatable axle extending substantially parallel with the knife support shaft comprising an outer surface in tight contact engagement with the sharp outer edges of said zigzag blades so that by rotating said knife support shaft, said roller is driven to rotate substantially in unison therewith to cut a sheet of paper passing through between said zigzag blades and said roller into small pieces.

2. A paper shredder as claimed in claim 1, wherein said roller comprises a coating made of a resilient material attached on the outer surface thereof to provide the tight contact engagement thereof with said zigzag blades.

3. A paper shredder as claimed in claim 2, wherein said resilient material comprises rubber.

* * * * *